US007528851B2

(12) United States Patent
Yoshida

(10) Patent No.: US 7,528,851 B2
(45) Date of Patent: May 5, 2009

(54) METHOD AND APPARATUS FOR FORMING IMAGES CAPABLE OF REDUCING COLOR REGISTRATION ERRORS

(75) Inventor: Yoshiki Yoshida, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 392 days.

(21) Appl. No.: 11/327,328

(22) Filed: Jan. 9, 2006

(65) Prior Publication Data

US 2006/0176354 A1 Aug. 10, 2006

(30) Foreign Application Priority Data

Jan. 7, 2005 (JP) ..... 2005-003258

(51) Int. Cl.
*B41J 2/385* (2006.01)
*G03G 15/01* (2006.01)

(52) U.S. Cl. ..... 347/116; 399/301

(58) Field of Classification Search ..... 347/116, 347/115, 237; 399/301
See application file for complete search history.

(56) References Cited

U.S. PATENT DOCUMENTS

| | | | | |
|---|---|---|---|---|
| 5,384,592 | A * | 1/1995 | Wong | 347/116 |
| 5,452,073 | A * | 9/1995 | Kataoka | 399/299 |
| 5,995,802 | A * | 11/1999 | Mori et al. | 399/394 |
| 6,317,147 | B1 * | 11/2001 | Tanaka | 347/116 |
| 6,782,814 | B2 * | 8/2004 | Tokiwa | 101/211 |
| 7,129,967 | B2 * | 10/2006 | Seki et al. | 347/249 |
| 2002/0012549 | A1 * | 1/2002 | OKU | 399/167 |
| 2003/0021613 | A1 * | 1/2003 | Koide | 399/167 |
| 2004/0239747 | A1 * | 12/2004 | Maeda | 347/116 |

FOREIGN PATENT DOCUMENTS

| | | |
|---|---|---|
| JP | 1-157668 | 6/1989 |
| JP | 6-113089 | 4/1994 |
| JP | 7-245682 | 9/1995 |
| JP | 9-27909 | 1/1997 |
| JP | 9-172525 | 6/1997 |
| JP | 9-200449 | 7/1997 |
| JP | 9-298628 | 11/1997 |
| JP | 10-108020 | 4/1998 |
| JP | 2946520 | 9/1999 |
| JP | 2000-19656 | 1/2000 |
| JP | 2000-284561 | 10/2000 |
| JP | 2001-86341 | 3/2001 |
| JP | 2001-209223 | 8/2001 |
| JP | 2003-279873 | 10/2003 |

* cited by examiner

*Primary Examiner*—An H. Do
*Assistant Examiner*—Sarah Al-Hashimi
(74) *Attorney, Agent, or Firm*—Oblon, Spivak, McClelland, Maier & Neustadt, P.C.

(57) ABSTRACT

An image forming apparatus including a memory device configured to prestore control information and registration pattern data, a traveling member, a toner pattern forming device forming a toner pattern, which includes a plurality of marks of a plurality of color components, on the traveling member according to the registration pattern data. A position detecting device detects each of the plurality of marks in the toner pattern. A control information correcting device corrects the control information according to a difference among positions of the plurality of marks, and a main-scan registration correcting device adjusts, based on the corrected control information, a start-of-write timing in the main scanning direction in a unit of a pixel clock cycle and adjusts a writing timing in the main scanning direction in a unit smaller than the pixel clock cycle by controlling a phase of the pixel clock cycle.

10 Claims, 11 Drawing Sheets

METHOD AND APPARATUS FOR FORMING IMAGES CAPABLE OF REDUCING COLOR REGISTRATION ERRORS

BACKGROUND OF THE INVENTION

1. Field of the Invention

This specification generally describes a method and an apparatus for forming images, and more particularly describes a so-called tandem method and an apparatus capable of forming images with reduced color registration errors.

2. Description of the Related Art

There is a background color image forming method and apparatus of a type often referred to as a tandem image forming method and apparatus.

The tandem image forming apparatus has a plurality of photoconductive members disposed therein in parallel, each of which corresponds to one of color components that form a target image data. The image forming apparatus further includes an optical writing device, an image forming device, and a traveling member. The traveling member may be either a conveyor member that conveys a transfer sheet thereon or an intermediate transfer member.

The optical writing device optically writes a latent image of each color on the corresponding photoconductive member. The image forming device develops the latent image into a toner image and transfers the toner image in a superposing manner to either the transfer sheet on the conveyor member or the intermediate transfer member.

The conveyor member and the intermediate transfer member are often shaped as a belt, but the shape thereof is not limited thereto.

A method in which the toner image is transferred directly onto the transfer sheet may be referred to as a direct transfer method. A method in which the toner image is first transferred onto the intermediate transfer member and then retransferred onto a transfer sheet may be referred to as an intermediate transfer method. Both the direct transfer method and the intermediate transfer method may be used.

Since the toner image of each color is formed on an individual photoconductive member, the toner images of respective color components after being transferred onto the transfer sheet or the intermediate transfer member may not be perfectly superposed on each other, thus creating color misregistration.

To correct the color misregistration, the background image forming apparatus may include a misregistration correction function to adjust a writing timing in the main scanning direction in a unit of a pixel width, which corresponds to a cycle of a pixel clock signal. The background image forming apparatus may further include a misregistration correction function to adjust a writing timing in the sub-scanning direction in a unit of a scan line width, which corresponds to a sub-scanning frequency.

SUMMARY OF THE INVENTION

A novel image forming apparatus of the present invention includes a memory device configured to prestore control information and registration pattern data, a traveling member, a toner pattern forming device forming a toner pattern, which includes a plurality of marks of a plurality of color components, on the traveling member according to the registration pattern data, a position detecting device detecting each of the plurality of marks in the toner pattern, a control information correcting device correcting the control information according to a difference among positions of the plurality of marks, and a main-scan registration correcting device adjusting, based on the corrected control information, a start-of-write timing in the main scanning direction in a unit of a pixel clock cycle and adjusting a writing timing in the main scanning direction in a unit smaller than the pixel clock cycle by controlling a phase of the pixel clock cycle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
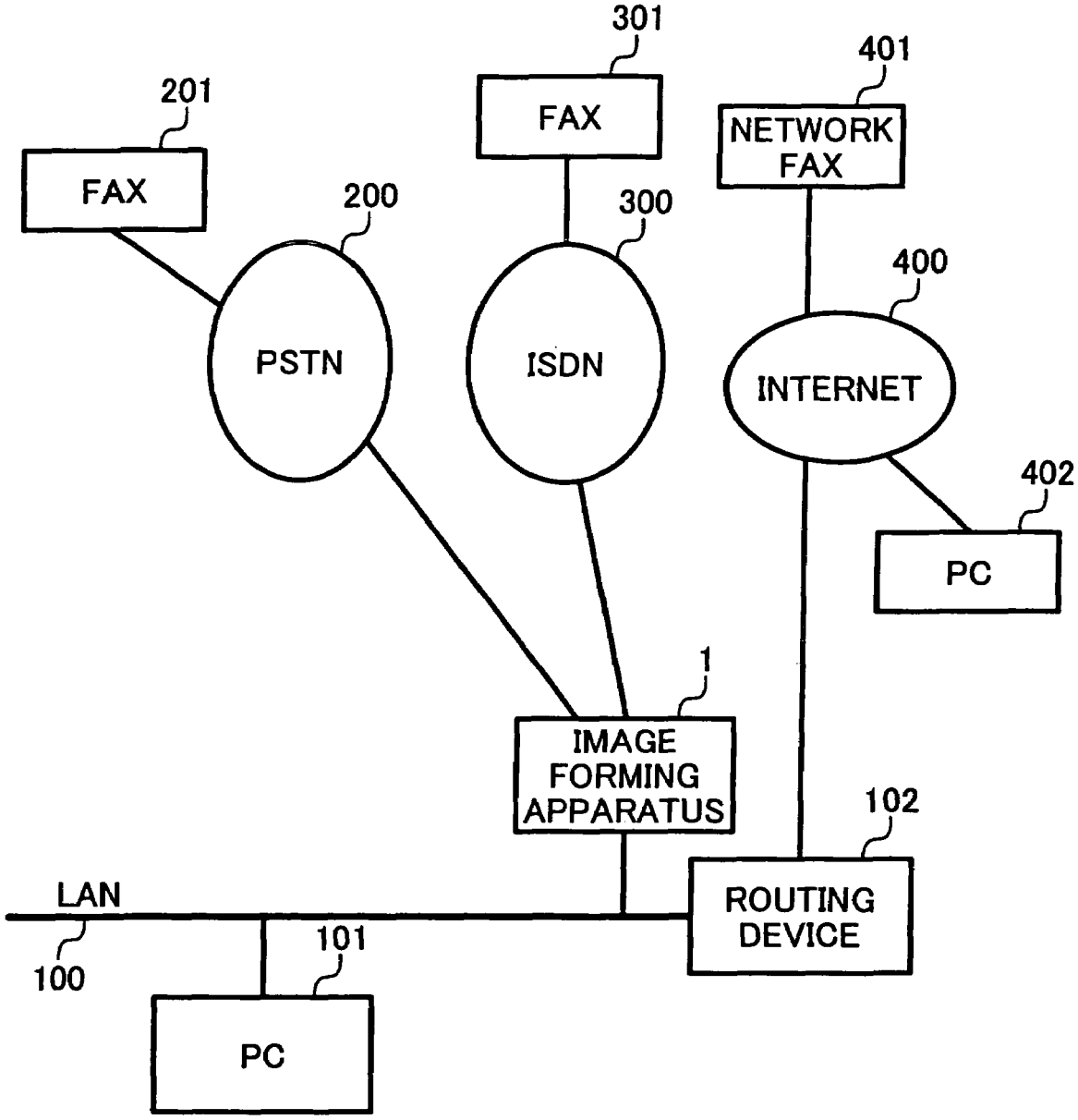
FIG. 1 is a schematic diagram illustrating an example system including an image forming apparatus according to an example embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an example system including an image forming apparatus 1 according to an example embodiment of the present invention is described.

In an example system illustrated in FIG. 1, the image forming apparatus 1 may be connected to networks such as a PSTN (public switched telephone network) 200, a LAN (local area network) 100, and an ISDN (integrated services digital network) 300. The image forming apparatus 1 is further connected to an Internet 400 through a routing device 102, which is disposed on the LAN 100 and is configured to convert packets.

There may be a facsimile machine (fax) 201 on the PSTN 200, a PC (personal computer) 101 on the LAN 100, a PC 402 and a network fax 401 on the Internet 400, and a fax 301 on the ISDN 300. Here, a plurality of each of the fax 201, the PC 101, the PC 402, the network fax 401, and the fax 301 may be included.

The image forming apparatus 1 and the fax 201 may exchange image data with each other over the PSTN 200. When the image forming apparatus 1 includes an interface to the ISDN 300, the image forming apparatus 1 and the fax 301 may exchange image data with each other over the ISDN 300. The image forming apparatus 1 and the PC 402 may exchange image data with each other by e-mail over the Internet 400. The image forming apparatus 1 and the network fax 401 may exchange image data to each other by e-mail or by a real-time facsimile communication procedure according to specifications such as the ITU-T Recommendation T.38. Further, the image forming apparatus 1 and the PC 101 may exchange image data with each other over the LAN 100.

In this manner, the image forming apparatus 1 serves as a multifunction apparatus providing a fax function through the PSTN 200 or the ISDN 300, a network fax function through the Internet 400, a scanner function and a printer function through the LAN 100, and a copier function.

Figure 2:
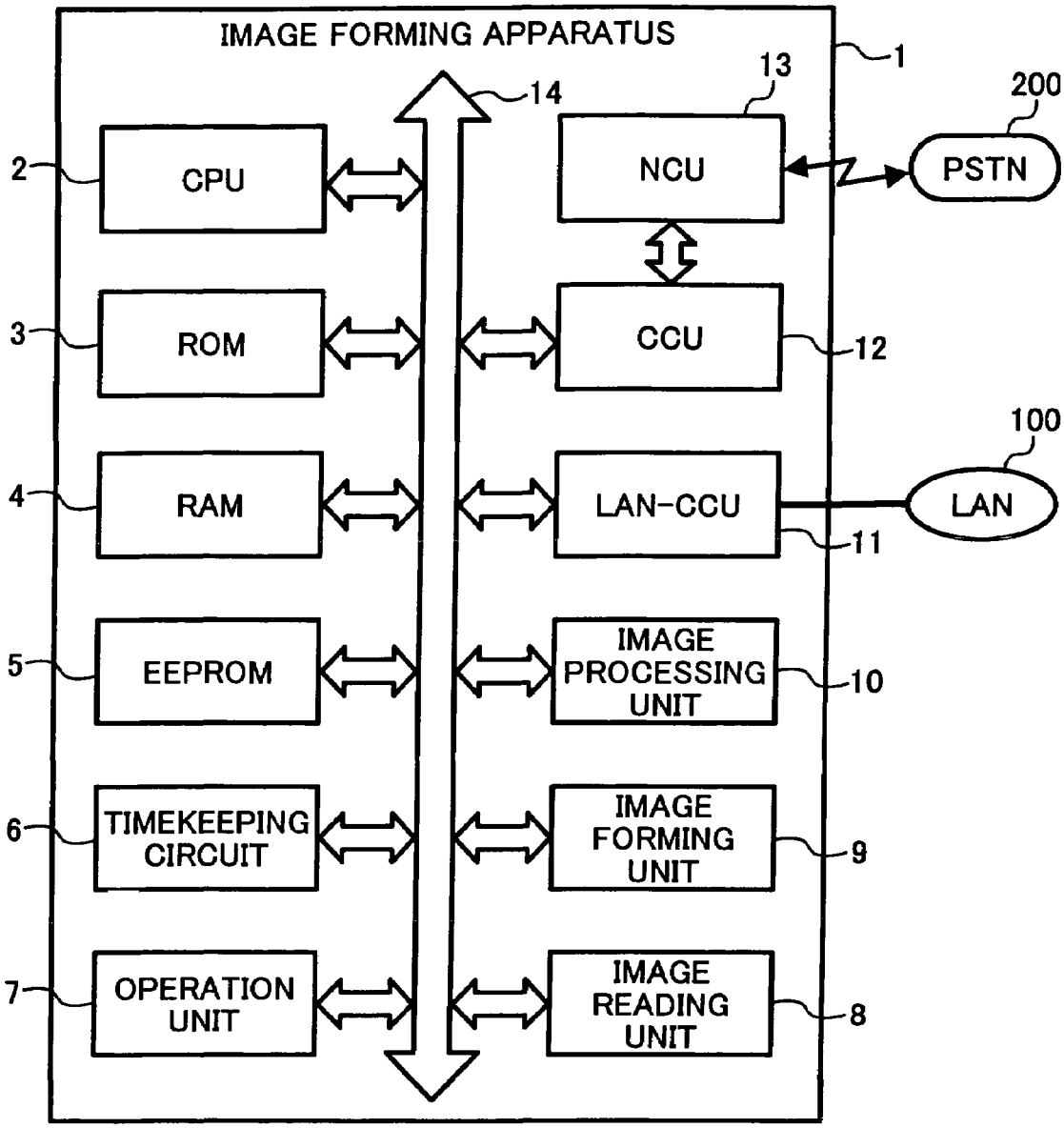
FIG. 2 is a block diagram for explaining a configuration of the image forming apparatus of FIG. 1.

Referring to FIG. 2, the image forming apparatus 1 includes a CPU 2, a ROM (read-only memory) 3, a RAM (random-access memory) 4, an EEPROM (electrically erasable programmable read-only memory) 5, a timekeeping circuit 6, an operation unit 7, an image reading unit 8, an image forming unit 9, an image processing unit 10, a LAN-Communication Control Unit (hereafter referred to as LAN-CCU) 11, a Communication Control Unit (hereafter referred to as CCU) 12, a Network Control Unit (hereafter referred to as NCU) 13, and a system bus 14.

The CPU 2 is a central processing unit that controls individual parts of the image forming apparatus 1 based on a control program stored in the ROM 3. The CPU 2 processes various data, and controls various protocols.

The ROM 3 is a read-only memory in which the control program used by the CPU 2 and various data necessary for the CPU 2 to control the image forming apparatus 1, such as a font data for each character code, are stored.

The RAM 4 is a random-access memory that serves as a work area for the CPU 2.

The EEPROM 5 stores information necessary for an operation of the image forming apparatus 1. The EEPROM 5 keeps the information even after the image forming apparatus 1 is powered off. The EEPROM 5 may be replaced by other rewritable memory devices such as a battery backed-up static RAM, a magnetic disk device, or the like.

The timekeeping circuit 6 counts a present time and date. The CPU 2 may acquire the present time and date by reading the timekeeping circuit 6 via the system bus 14.

The operation unit 7 includes an input device to receive an instruction from a user. The operation unit 7 includes a display to notify the user of necessary information such as an operation status and a message.

The image reading unit 8 reads an original and obtains image data of the original.

The image forming unit 9 forms an image and prints out the image on a recording medium, which operation will be specifically discussed later.

The image processing unit 10 processes the image data used in the image forming apparatus 1. Examples of the image processing performed by the image processing unit 10 includes encoding and compression of raw image data, decoding and decompression of the encoded and compressed data, binarization, scaling, zooming, image compensation, sorting of the order of pixels on the main scan line of the image data, and adding of optional information such as sent or received date and time.

The LAN-CCU 11 is a so-called network interface card (NIC). The LAN-CCU 11 connects the image forming apparatus 1 to the LAN 100 using LAN protocols. The LAN-CCU 11 allows the CPU 2 to communicate using TCP/IP protocols over the LAN protocols so that the image forming apparatus 1 may exchange various kinds of information using higher-level protocols.

The CCU 12 is connected to the PSTN 200 via the NCU 13. The CCU 12 controls the NCU 13 to control a communication with a communication terminal on the other end. Examples of operations of the CCU 12 include a detection of a pulse of a ringing voltage detected by the NCU 13, a detection of a dual-tone multi-frequency (DTMF) signal, a detection of a tone signal, and a calling operation at a time of sending. Further, the CCU 12 may include a modem so that the CCU 12 may demodulate modulated data received from a communication terminal on the other end, and may modulate data at a time of sending. Specifically, the CCU 12 includes a low-speed modem function (V.21 modem) for exchanging a G3 facsimile control signal based on ITU-T Recommendation T.30, high-speed modem functions such as V.17, V.33, V.34, V.29, and V.27ter mainly for exchanging documents and image data.

The NCU 13 is connected to the PSTN 200. Examples of operations of the NCU 13 include a closing of a line and a detection of a calling signal (i.e. a ringing).

The system bus 14 is a bus through which data is exchanged between each of the above-mentioned components of the image forming apparatus 1. The system bus 14 is formed of a plurality of signal lines such as a data bus, an address bus, a control bus, and an interrupt signal line.

Having the above-mentioned components, the image forming apparatus 1 according to the example embodiment may form image data on a recording medium serving as a printer, a receiving side of a facsimile machine, and a copier.

Figure 3:
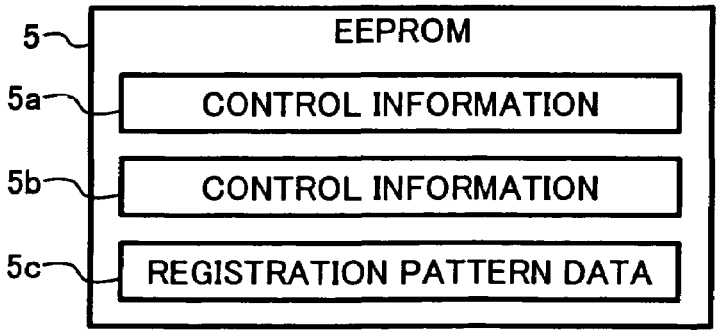
FIG. 3 is a schematic diagram for describing what is stored in an EEPROM of the image forming apparatus of FIG. 2.

As illustrated in FIG. 3, the EEPROM 5 has memory areas storing control information 5*a*, control information 5*b*, and registration pattern data 5*c*.

The control information 5*a* is a group of information that controls a writing timing in the main scanning direction for all the color components.

The control information 5*b* is a group of information that controls a writing timing in the sub-scanning direction for all the color components.

The registration pattern data 5*c* is special image data to be used for forming a registration pattern.

It is to be noted that the control information 5*a* and 5*b* will be corrected so as to compensate a misregistration, which may be detected through forming and reading of the registration pattern.

Figure 4:
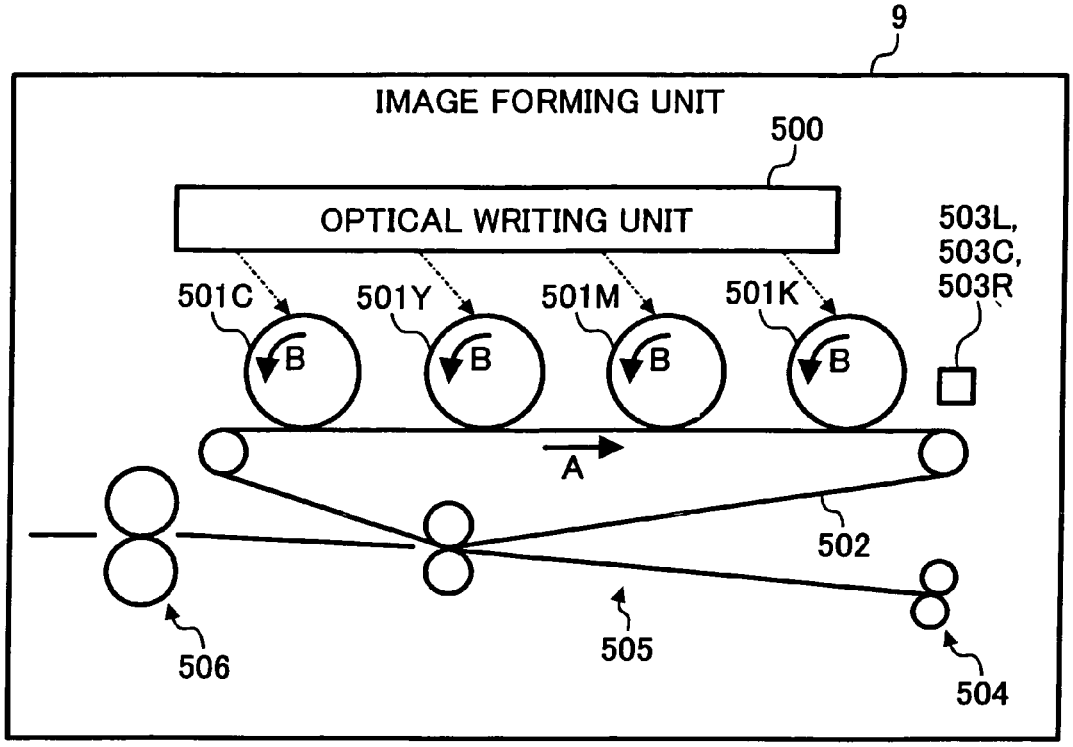
FIG. 4 is a schematic diagram for explaining an operation of an image forming unit of the image forming apparatus of FIG. 2.

As illustrated in FIG. 4, the image forming unit 9 of the image forming apparatus 1 is a so-called tandem image forming unit. Although FIG. 4 depicts the image forming unit 9 using an intermediate transfer method in which toner images are once transferred onto a surface of a intermediate transfer member and then further transferred onto a transfer sheet (i.e. a recording medium), the image forming unit 9 may alternatively employ a direct transfer method in which toner images are directly transferred onto a transfer sheet conveyed on a conveyor member. The intermediate transfer member and the conveyor member are often shaped as a belt as in the example embodiment, but the shape thereof is not limited thereto.

The image forming unit 9 includes a belt 502 serving as an intermediate transfer member, an optical writing unit 500, registration sensors 503L, 503C, and 503R, a sheet feeder system 504, a conveyor system 505, a fixing system 506, and photoconductive drums (hereafter referred to as PC drums) 501C, 501Y, 501M, and 501K corresponding to different color components.

For purposes of explanation, the color components include, but are not limited to, a cyan component (hereafter abbreviated as C), a yellow component (hereafter abbreviated as Y), a magenta component (hereafter abbreviated as M), and a black component (hereafter abbreviated as K). The number and a type of the color components are not limited thereto, and the number of the PC drums may vary depending on the number of color components.

The belt 502 is supported by a plurality of rollers rotationally driven. A top face of the belt 502 horizontally moves in a direction indicated by an arrow A as viewed in FIG. 4.

The direction A in which the top face of the belt 502 travels is hereafter referred to as a sub-scanning direction. On the other hand, a width direction of the belt 502 perpendicular to the sub-scanning direction is referred to as a main scanning direction.

The horizontal top face of the belt 502 is in contact with the aligned PC drums 501C, 501Y, 501M, and 501K, each of which are rotationally driven independently in a direction indicated by an arrow B. In a background example, a rotational speed (i.e. a circumferential speed) of each PC drum 501C, 501Y, 501M, and 501K in the direction B may be set substantially equal to a moving speed of the belt 502 in the sub-scanning direction. On the other hand, in the example embodiment, each of the PC drums 501C, 501Y, 501M, and 501K may be driven by an individual driving system, so that each of the PC drums 501 C, 501Y, 501M, and 501K may have an individual rotational speed.

On a downstream side of the PC drums 501C, 501Y, 501M, and 501K in the sub-scanning direction, the registration sensors 503L, 503C, and 503R are arranged equally spaced with each other along the main scanning direction, so as to face left, center, and right portions of the belt 502, respectively.

Each of the registration sensors 503L, 503C, and 503R may be an optical reflection-type sensor including a light-receiving element, and may detect one of the registration patterns formed on a corresponding location of the belt 502.

Outer surfaces of the PC drums 501C, 501Y, 501M, and 501K may be uniformly charged by a charging unit (not shown).

For each color, the optical writing unit 500 generates a laser beam, having its intensity modulated according to image data of the respective color, to discharge the uniformly charged surfaces of the PC drums 501C, 501Y, 501M, and 501K according to the intensity of the respective laser beams.

At this time, the optical writing unit 500 may precisely adjust a writing timing in the main scanning direction at a level less than a width of a pixel (i.e. a frequency of a pixel clock signal) based on the control information 5*a* of FIG. 3.

Meanwhile, the optical writing unit 500 may correct a writing timing in the sub-scanning direction to a level less than a width of a scan line based on the control information 5*b* of FIG. 3.

In this manner, a latent image may be written to each of the PC drums 501C, 501Y, 501M, and 501K.

The latent image of each color formed in the above manner may be developed into a toner image by a developing unit (not shown) for each color component. Each toner image on the PC drums 501C, 501Y, 501M, and 501K may be transferred onto the belt 502 in a superposing manner, creating a multi-color toner image.

Since the optical writing unit 500 may precisely adjust a writing timing in the main and sub-scanning directions as described above, the transferred multi-color toner image is well-registered.

The multi-color toner image on the belt 502 is further transferred onto a sheet on the conveyor system 505, which is fed by the sheet feeder system 504. After the fixing system 506 affixes the multi-color image to the sheet with heat, the sheet is output.

Figure 5:
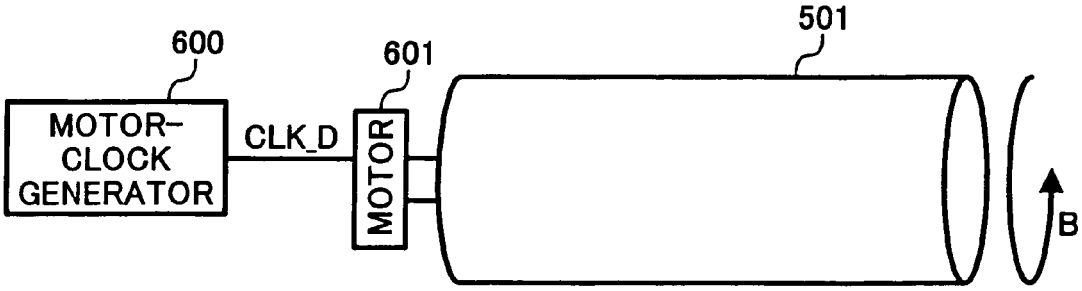
FIG. 5 is a schematic diagram of each of photoconductive drums (hereafter referred to as PC drums) of the image forming unit of FIG. 4.

In FIG. 5, a PC drum 501 represents any one of the PC drums 501C, 501Y, 501M, and 501K. As illustrated, the PC drum 501 is rotationally driven by a motor 601 serving as a rotary drive mechanism for each PC drum 501. A speed of the motor 601 may be relatively determined by a frequency of a clock CLK_D, which is output from a motor-clock generator 600. Therefore, a rotational speed of each of the PC drums 501C, 501Y, 501M, and 501K may be independently adjusted by setting the frequency of the clock CLK_D, output from the motor-clock generator 600.

Figure 6A:
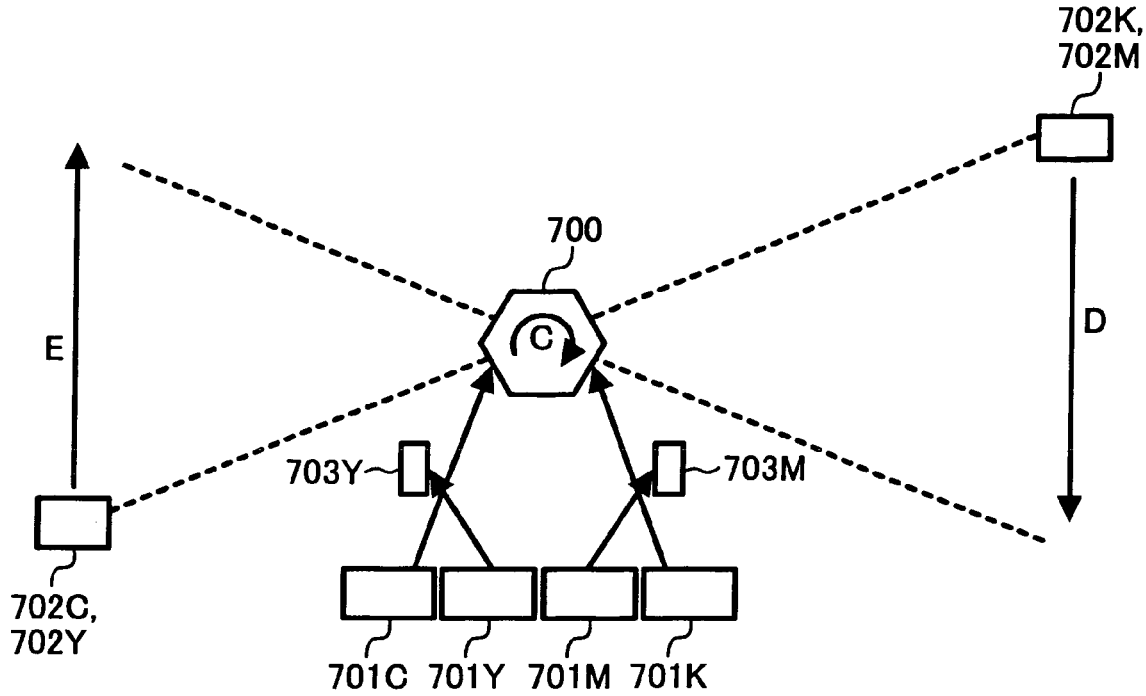
FIGS. 6A and 6B are a top view and a side view for explaining an operation of an optical writing unit of the image forming unit of FIG. 4.
Figure 6B:
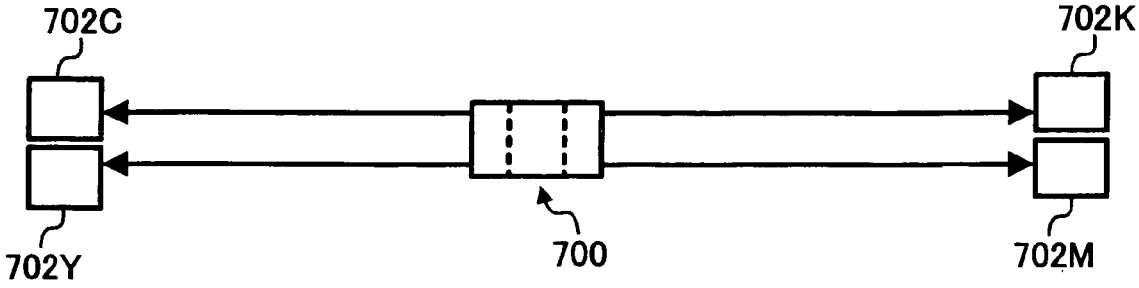

Referring to FIGS. 6A and 6B, an operation of the optical writing unit 500 is specifically described. The optical writing unit 500 includes a polygon shaped mirror (hereafter referred to as polygon mirror) 700, LD units 701C, 701Y, 701M, and 701K, synchronization detectors (hereafter referred to as sync detectors) 702C, 702Y, 702M, and 702K, and mirrors 703Y and 703M.

The polygon mirror 700 may rotate in a direction indicated by an arrow C. The LD units 701C, 701Y, 701M, and 701K may emit laser beams for C, Y, M and K, respectively, toward the rotating polygon mirror 700. Each of the laser beams is reflected off a reflective facet of the polygon mirror 700 to be further reflected by a mirror (not shown) toward the PC drums 501C, 501Y, 501M, and 501K, respectively. Meanwhile, the laser beams for C, Y, M, and K may be caused to pass the sync detectors 702C, 702Y, 702M, and 702K, respectively. Each of the sync detectors 702C, 702Y, 702M, and 702K obtains a synchronization pulse to be used as a timing reference for writing in the main scanning direction.

The laser beams for C and K from the LD units 701C and 701K are emitted to an upper reflective portion of the polygon mirror 700. On the other hand, laser beams for Y and M from the LD units 701Y and 701M are emitted to the mirrors 703Y and 703M, respectively, to be reflected therefrom to a lower reflective portion of the polygon mirror 700. In this manner, the polygon mirror 700 is shared among the color components, C, Y, M, and K.

The laser beams for C and Y scan along the main scanning direction in a direction indicated by an arrow E. On the other hand, the laser beams for M and K scan along the main scanning direction in a direction indicated by an arrow D, which is opposite from the direction E. That is, when a line of an image consisting of C, Y, M and K is formed, a C and Y pair and an M and K pair of laser beams are scanned in opposite directions.

Figure 7:
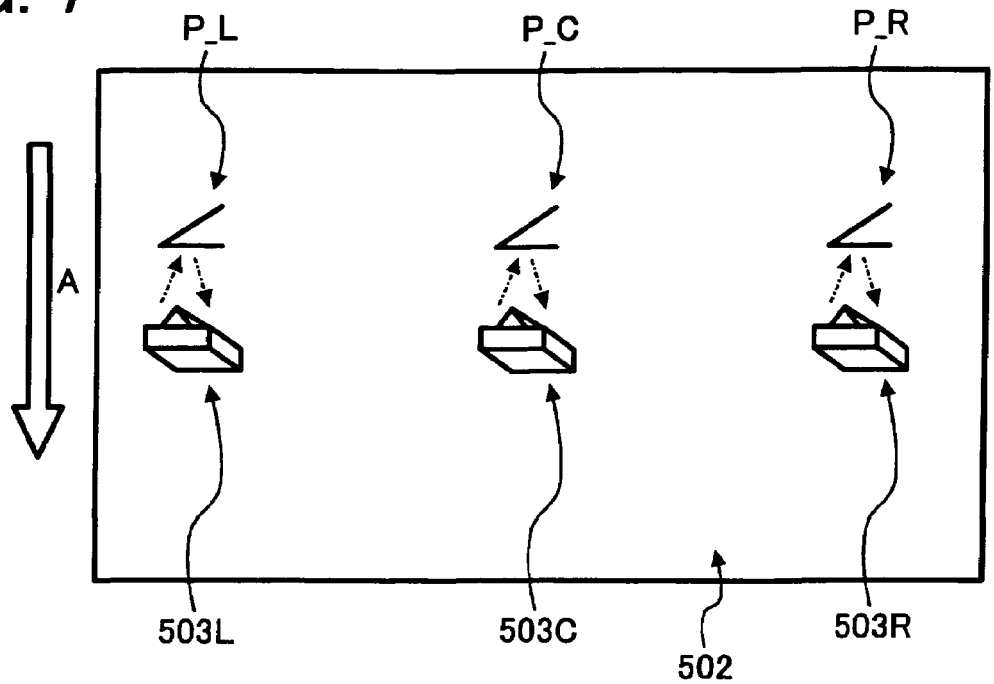
FIG. 7 is an illustration for explaining how a registration pattern is detected by a registration sensor of the image forming unit of FIG. 4.
Figure 8:
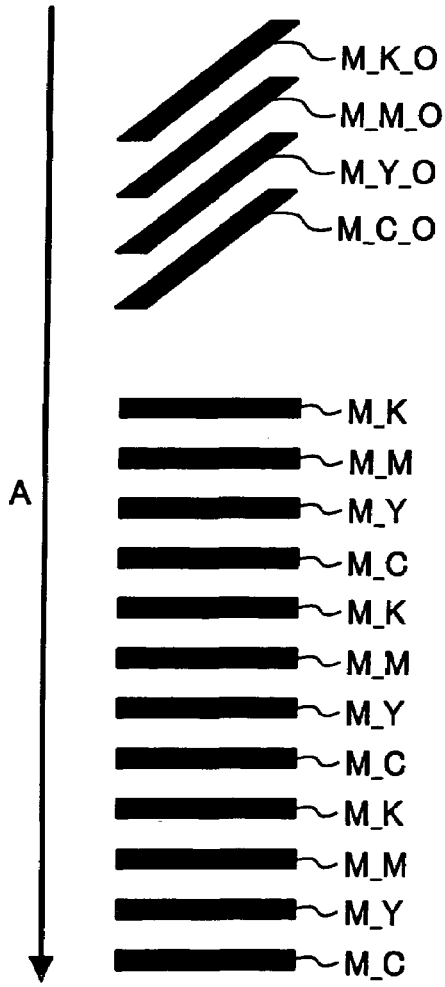
FIG. 8 illustrates an example of each of the registration patterns of FIG. 7.

Next, the manner in which a misregistration is detected will be discussed with reference to FIGS. 7 and 8. In FIGS. 7 and 8, arrows A indicate the sub-scanning direction, in which the belt 502 travels.

As illustrated in FIG. 7, registration patterns P_L, P_C, and P_R are formed on the left, center, and right portions of the belt 502, respectively. The registration sensors 503L, 503C, and 503R are disposed equally spaced with each other along the main scanning direction. The registration sensors 503L, 503C, and 503R may emit light onto patterns P_L, P_C, and P_R on the belt 502, respectively, as illustrated in dash-dot lines in FIG. 7. The light-receiving element of the registration sensors 503L, 503C, and 503R may receive the light reflected from patterns P_L, P_C, and P_R, respectively, as illustrated in dash-dot lines in FIG. 7.

In this manner, the registration sensors 503L, 503C, and 503R may detect a positional difference in the main and sub-scanning directions among color components included in patterns P_L, P_C, and P_R, respectively.

FIG. 8 illustrates a configuration of any one of patterns P_L, P_C, and P_R. Each of patterns P_L, P_C, and P_R includes a plurality of registration marks M_C, M_Y, M_M and M_K, each formed of C, Y, M, and K toner, and oblique registration marks M_C_O, M_Y_O, M_M_O, and M_K_O, each formed of C, Y, M, and K toner.

Marks M_C, M_Y, M_M and M_K are formed on the belt 502 to be parallel to the main scanning direction. Thereafter, marks M_C_O, M_Y_O, M_M_O, and M_K_O are formed to be oriented at substantially 45 degrees with respect to the main scanning direction. Marks M_C_O, M_Y_O, M_M_O, and M_K_O are used for determining a positional difference in the main scanning direction, as a conversion from a positional difference in the sub-scanning direction.

Based on the relationship among detected positions of marks M_C, M_Y, M_M and M_K, a misregistration in the sub-scanning direction, hereinafter referred to as a sub-scan misregistration, may be detected.

According to the detection result, the control information 5*b* illustrated in FIG. 3 may be updated so that the optical writing unit 500 may adjust the start-of-write timings of each color in the sub-scanning direction. That is, based on one color component, K for example, the start-of-write timings of the other color components, C, Y, and M for example, are adjusted in the sub-scanning direction in a unit of a scan line.

Thereafter, a misregistration smaller than a scan line width may be corrected by slightly adjusting the rotational speed of respective PC drums 501C, 501Y, 501M, and 501K. That is, based on one PC drum, 501K for example, the rotational speed of the other PC drums 501C, 501Y, and 501M are slightly increased or decreased in a manner specifically described later.

Based on the relationship among detected positions among the set of marks M_C, M_Y, M_M and M_K and the set of registration marks M_C_O, M_Y_O, M_M_O, and M_K_O, a misregistration in the main scanning direction, hereinafter referred to as a main-scan misregistration, among C, Y, M and K as well as a widening or a shrinkage of pixels in a left part and in a right part of the scan line in each of C, Y, M and K may be detected. The left part refers to a range of the scan line between the registration sensors 503L and 503C. The right area refers to a range of the scan line between the registration sensors 503C and 503R.

According to a detection result, the control information 5*a* illustrated in FIG. 3 may be updated so that the optical writing unit 500 may correct the start-of-write timings of each color component in the main scanning direction. That is, based on one color component, K for example, the start-of-write timings of the other color components, C, Y, and M for example, are corrected in the main scanning direction in a unit of a pixel width (i.e. a pixel clock frequency).

Thereafter, a misregistration smaller than a pixel width may be corrected by controlling a phase (i.e. changing a frequency) of a pixel clock signal corresponding to some of the pixels forming a scan line, in a manner specifically described later.

It should be noted that in the image forming apparatus 1 according to the example embodiment the main-scan and sub-scan misregistrations are corrected, but is not in any way limited by a manner in which the main-scan and sub-scan misregistrations are detected.

Figures 9, 10:
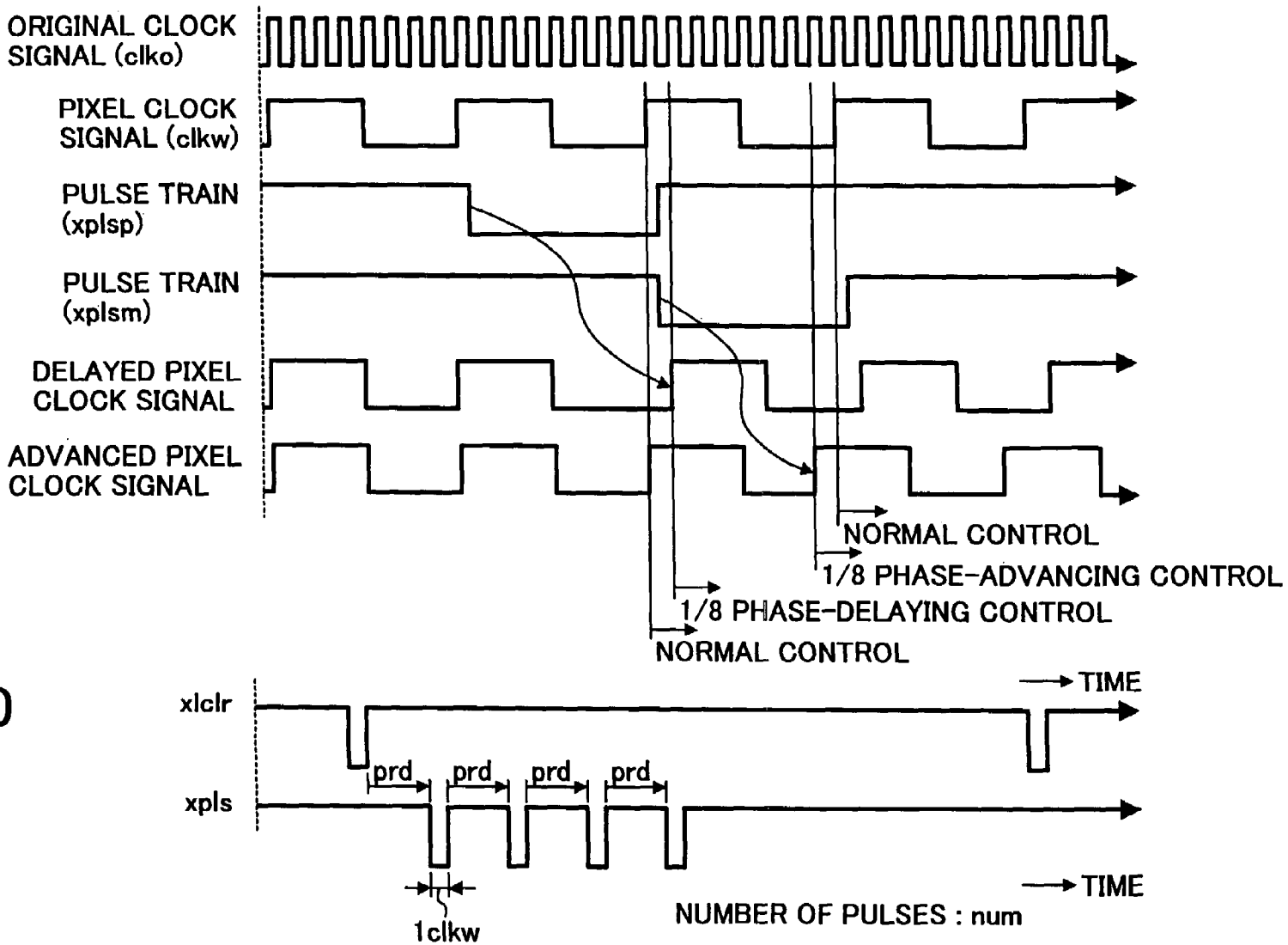
FIG. 9 is a timing diagram for explaining how a pixel clock signal is phase-controlled so as to correct a main-scan misregistration smaller than a clock frequency.
FIG. 10 is a timing diagram corresponding to FIG. 9 for explaining how many times and how frequently the pulses of phase control signals are generated in a line of a main scan operation.

Referring now to FIG. 9, the manner in which a pixel clock is phase-controlled so as to correct a main-scan misregistration at a level smaller than a clock frequency is explained.

In FIG. 9, an original clock signal clko serves as a reference clock signal from which a pixel clock signal clkw is generated. A cycle of clkw basically corresponds to eight cycles of clko. That is, the pixel clock clkw before the phase control has a 50%-duty cycle and a ⅛-frequency.

It should be noted that, in principle, a cycle of clkw may correspond to a different number of cycles of clko, for example 16. For purposes of explanation, a cycle of clkw corresponds to eight cycles of clko in the example embodiment.

Pulse trains xplsp and xplsm are phase control signals used for controlling a phase of clkw. A pulse of xplsp (i.e. an xplsp pulse) may delay clkw, and an xplsm pulse may advance clkw.

The pixel clock clkw is phase-controlled in a following manner. A first leading edge of clkw after a falling edge of xplsp is controlled to delay for a cycle of clko, that is ⅛-cycle of clkw in the example embodiment, which operation is referred to as a phase delaying control.

In a similar manner, a first leading edge of clkw after a falling edge of xplsm is controlled to advance for a cycle of clko, that is ⅛-cycle of clkw in the example embodiment, which operation is referred to as a phase advancing control.

Assume that a "shrinkage" comparable to ¼-cycle of clkw has occurred in the left part of the scan line, and that a "widening" comparable to ¼-cycle of clkw has occurred in the right part of the scan line. Such main-scan misregistrations within a color component may be corrected by generating xplsp two times in the left part and generating xplsm two times in the right part.

Further, a main-scan misregistration among different color components smaller than a pixel width, which may not be corrected by a correction in a unit of the cycle of clkw, may also be corrected by setting, for each color component, a timing and a cycle of xplsp and xplsm to be generated on the main scan line.

FIG. 10 is a timing diagram corresponding to FIG. 9 for explaining how many times and how frequently the pulses of the phase control signals are generated.

In FIG. 10, a synchronization pulse xlclr corresponds to a signal detected by any one of the sync detectors 702C, 702Y, 702M, and 702K, and serves as a reference point of starting a line of scan.

A pulse train xpls represents xplsp and/or xplsm of FIG. 9. A period prd is a set value for determining an interval at which pulses of xpls (i.e. xpls pulses) are generated. A num is a set value for determining the number of times pulses are generated. By setting prd and num, num numbers of xpls pulses are generated at an interval of prd, so that corresponding pixels in a scan line are widened (in the case of xplsp) or shortened (in the case of xplsm) by a ⅛-cycle of clkw.

Figure 11:
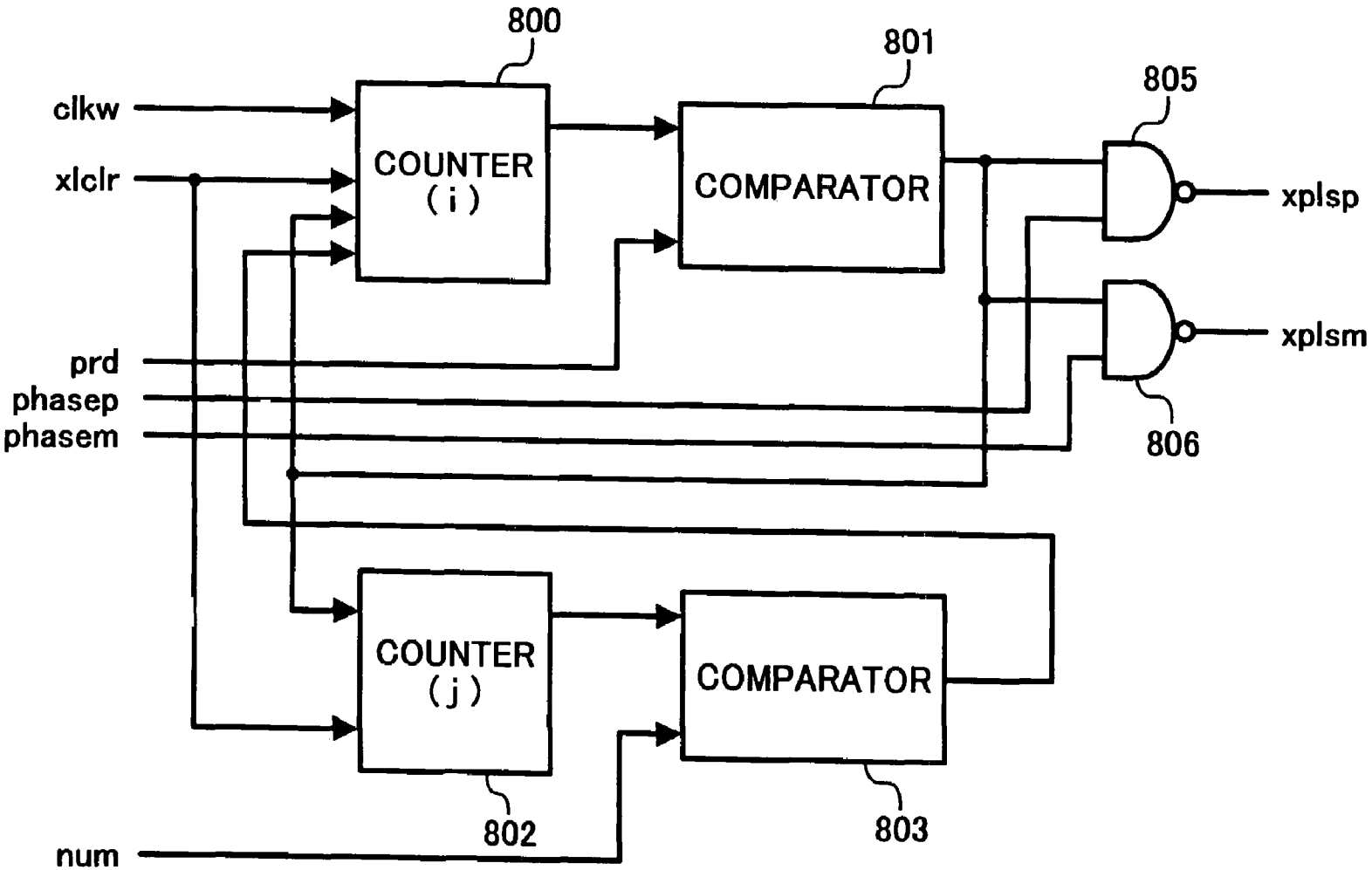
FIG. 11 is an example pulse generating circuit corresponding to timing diagrams of FIGS. 9 and 10, for explaining how the phase control signals are generated.

Referring to FIG. 11, a pulse generating circuit for generating xplsp and xplsm are described. The pulse generating circuit includes counters 800 and 802, comparators 801 and 803, and NAND gates 805 and 806.

The counter 800 counts the number of pulses of the pixel clock signal clkw and outputs a count value to the comparator 801. The synchronization pulse xlclr serves as a reset input to the counters 800 and 802.

A set value of prd of FIG. 10 is input to the comparator 801 as a reference for comparison. The comparator compares a counter value from the counter 800 with prd, and outputs a pulse every time the counter value reaches prd. The pulse is input to the counter 800 as a reset input and is also input to the counter 802 to be counted. Further, the pulse is input to each of the NAND gates 805 and 806 as a gating input.

Phasep and phasem are setpoint signals input to NAND gates 805 and 806, respectively. Phasep requests an output of an xplsp pulse; phasem requests an output of an xplsm pulse. When a pulse is input from the comparator 801, an xplsp pulse will be output when phasep is set, and an xplsm pulse will be output when phasem is set.

The counter 802 counts the cumulative number of pulses output from the comparator 801, and outputs a counter value to the comparator 803. The comparator 803 compares the counter value with num, which is a set value determining the number of pulses, and outputs an equal-output signal when the counter value and num is equal to each other. The equal-output signal is input to the counter 800 and serves as a stop signal to stop a counting operation.

Then, in each scan line, xplsp or xplsm pulses for a number of times preset as num are generated at an interval (i.e. the number of pulses of clkw) preset as prd. At timings in which xplsp or xplsm pulses are generated, phases of corresponding clkw pulses are delayed or advanced for ⅛ of the pixel clock cycle. In this manner, misregistration smaller than a pixel clock cycle may be corrected.

Figure 12:
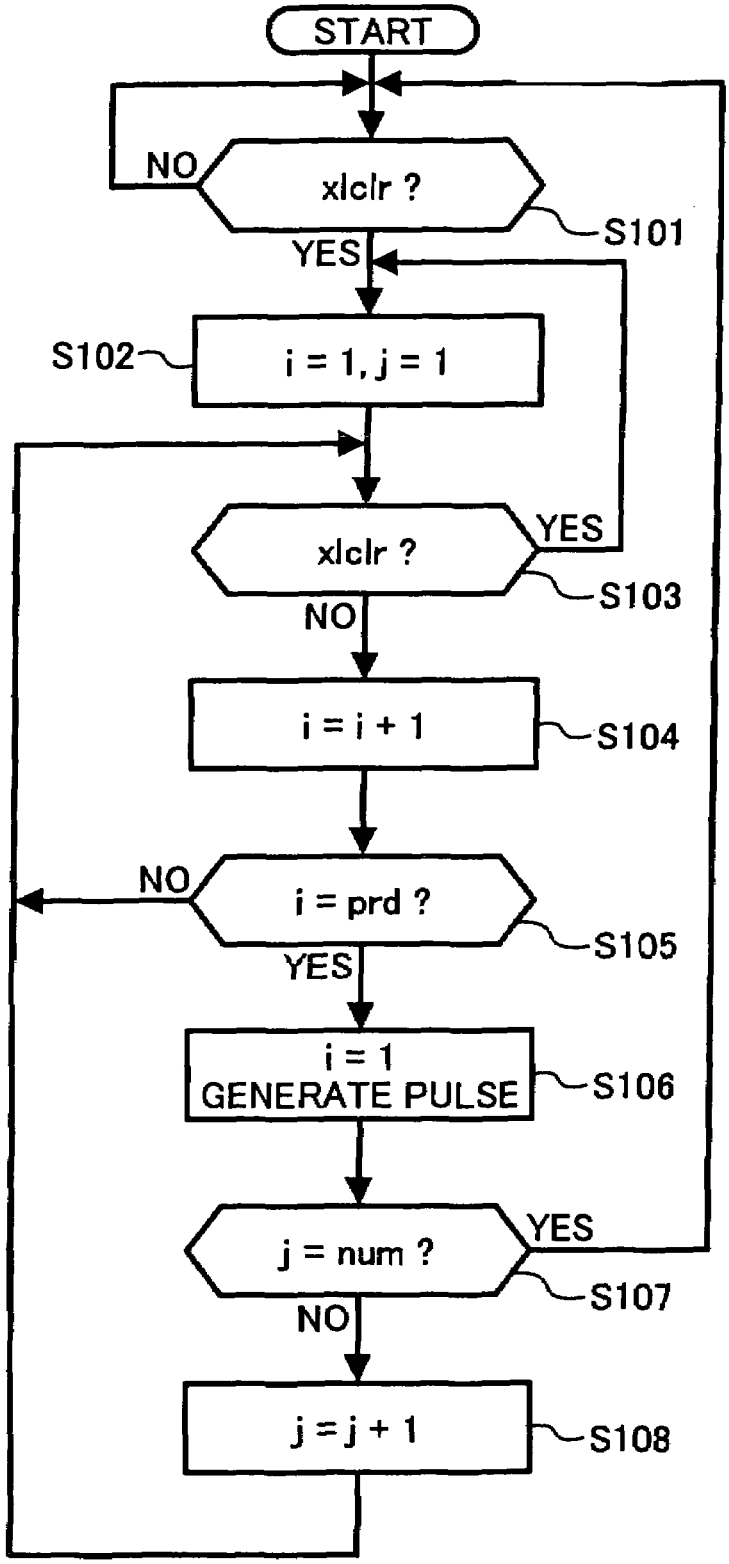
FIG. 12 is a flowchart for explaining the operation of the pulse generating circuit of FIG. 11.

An operational flow of the pulse generating circuit of FIG. 11 is shown in a flowchart in FIG. 12. Variables i and j correspond to counter values of the counters 800 and 802, respectively.

In S101, a determination is made whether an xlcr pulse, serving as a timing reference for starting a line of scan, has been input. If the determination is NO in S101, the process returns to the start to wait for an xlcr pulse input (i.e. a NO loop in S101). If the determination in S101 is YES, in S102, the counters 800 and 802 reset their counter values i and j to 1, respectively.

Then, in S103, a determination is made whether a next pulse of xlcr is input. When the determination is NO in S103, the process proceeds to S104 in which the counter 800 counts a number of clkw pulse by incrementing i by one. Then, in S105, a determination is made by the comparator 801 whether i is equal to the set value prd. When i is not equal to prd (i.e. NO in S105), the process returns to the determination in S103.

In S103, if a next pulse of xlcr is input, YES in S103, the process returns to S102 to repeat a similar operational flow in the next scan line.

If the determination in S105 is YES (i.e. i has reached prd), in S106, the counter 800 resets i to 1, and the comparator 801 outputs a pulse so that an xplsp pulse or an xplsm pulse is generated.

Thereafter, in S107, a determination is made by the comparator 803 whether j of the counter 802 has reached the set value num. If the determination in S107 is YES, the process returns to S101 to repeat a similar operational flow in the next scan line.

If j has not reached num yet (i.e. NO in S107), the counter 802 increments j by one in S108 to return to S103.

Figure 13A:
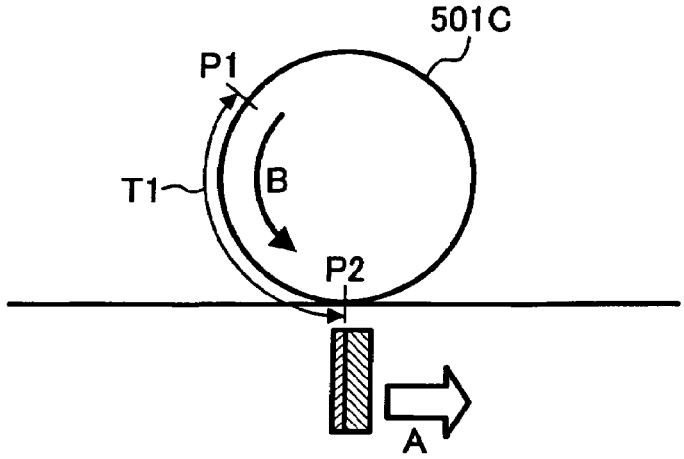
FIGS. 13A, 13B, and 13C are illustrations for explaining how a sub-scan misregistration smaller than a width of a scan line is corrected.
Figure 13B:
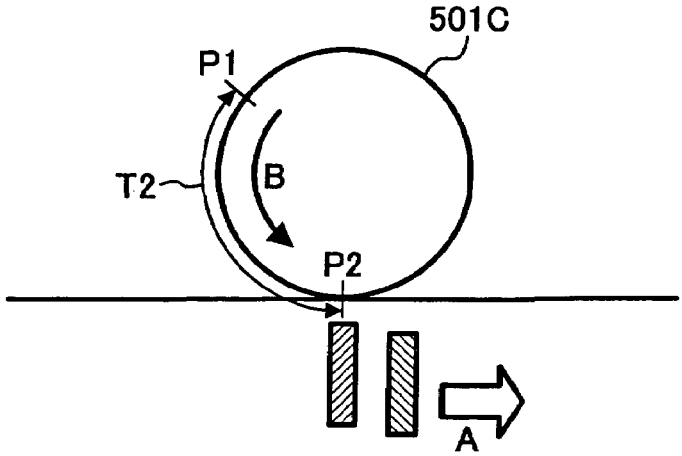
Figure 13C:
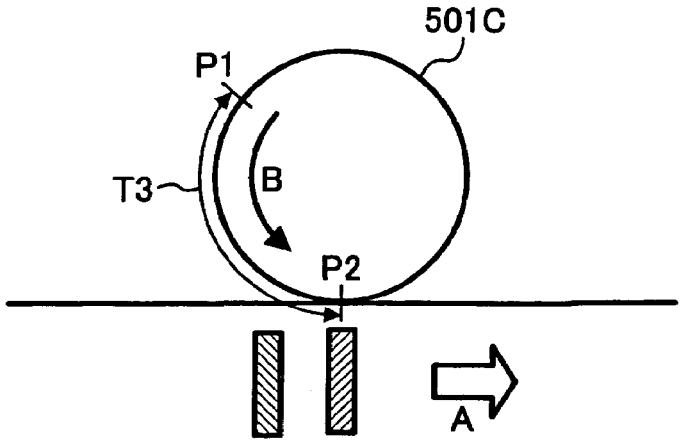

Next, referring to FIGS. 13A, 13B, and 13C, a discussion is given of how a sub-scan misregistration smaller than a width of a scan line, which may not be corrected by adjusting the start-of-write timing in a unit of a scan line, may be corrected. In FIGS. 13A, 13B, and 13C, the PC drum 501C for cyan is taken as an example for purposes of explanation. However, a discussion below may also be applicable to the PC drums 501M, 501Y, and 501K. A position P1 is a LD-writing position on the PC drum 501C to which a laser beam for C is written. A position P2 is a transfer position on the PC drum 501C where toner of C is transferred to the belt 502 from the PC drum 501C. Each of T1, T2, and T3 in FIGS. 13A, 13B, and 13C, respectively, depicts a time it takes for the PC drum 501C to travel from P1 to P2.

FIG. 13A illustrates a state in which the PC drum 501C, for example, has a rotational speed equal to an optimum speed, V. In this case, P2 becomes substantially the same as transfer positions of colors other than C. Therefore, a sub-scan misregistration may be corrected by a start-of-write timing adjustment in a unit of line. Thus, a transferred image is not subject to color misregistration.

FIG. 13B illustrates a state in which the PC drum 501C, for example, has a rotational speed slower than V. In this case, T2 becomes longer than T1, and P2 falls behind transfer positions of other color components. Therefore, a sub-scan misregistration may not be completely corrected by a start-of-write timing adjustment in a unit of line.

FIG. 13C illustrates a state in which the PC drum 501C, for example, has a rotational speed faster than V. In this case, T3 becomes shorter than T1, and P2 goes ahead of transfer positions of other color components. Therefore, a sub-scan misregistration may not be completely corrected by a start-of-write timing adjustment in a unit of line.

To change the state illustrated in FIGS. 13B and 13C into a state illustrated in FIG. 13A, a PC drum for one color component, for example the PC drum 501C, may be set as a reference drum. On the reference drum, a period between a time at which writing has started at a LD-writing position and a time at which a first line has reached a transfer position is set as a reference time. The rest of the PC drums, 501C, 501Y, and 501M in this example, may be adjusted to reach the transfer position taking a time equal to the reference time. In other words, relative to the rotational speed of the reference PC drum, the rotational speeds of the rest of the PC drums are slightly increased or decreased.

As a result, the rotational speeds of each of the PC drums 501C, 501M, 501Y, and 501K may be slightly different from each other. That is, the rotational speeds (i.e. the circumferential speeds) of each of the PC drums 501C, 501M, 501Y, and 501K may not be equal to the moving speed of the transfer belt 502.

An image formed in a unit of a main-scan line at a predetermined period T on each of the PC drums 501C, 501M, 501Y, and 501K is transferred onto the belt 502 traveling in the sub-scanning direction at a constant speed in a unit of a main-scan line at the predetermined period T. Therefore, even when the rotational speed of each of the PC drums 501C, 501M, 501Y, and 501K is not equal to the moving speed of the transfer belt 502, a transferred image of each component may not be elongated or shortened in the sub-scanning direction.

Further, since the differences between the moving speed of the belt 502 and rotational speed of each of the PC drums 501C, 501M, 501Y, and 501K are very little, i.e. in a level smaller than a line of scan, the difference may not cause each of the PC drums 501C, 501M, 501Y, and 501K to significantly slip on the belt 502.

Therefore, a presence of differences between each of the PC drums 501C, 501M, 501Y, and 501K may not cause degradation of image quality in successive transfer operations following a transfer of the first line.

The rotational speed of each of the PC drums 501C, 501Y, 501M, and 501K may be varied when a cycle of the clock output CLK_D from the motor-clock generator 600 as has been mentioned with reference to FIG. 5 is varied.

Figure 14:
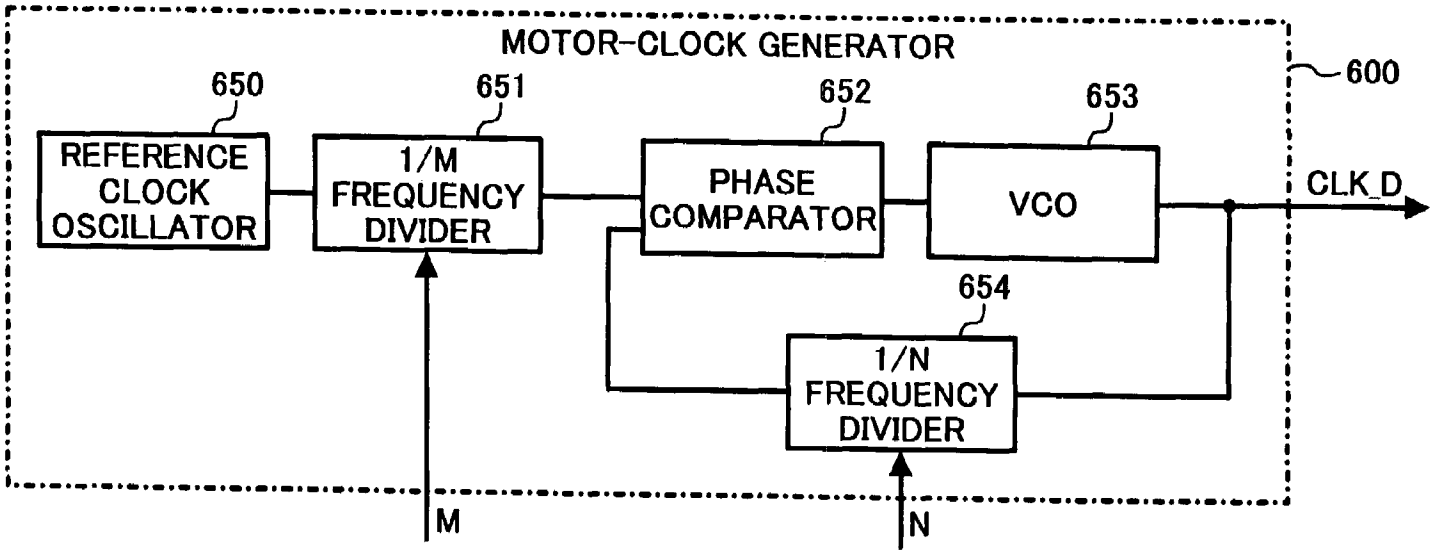
FIG. 14 is a diagram for explaining an example circuit of the motor-clock generator of FIG. 5.

Referring to FIG. 14, a configuration of an example circuit of the motor-clock generator 600 is described. The so-called PLL-type circuit includes a reference clock oscillator 650, a 1/M frequency divider 651, a phase comparator 652, a VCO (voltage-controlled oscillator) 653, and a 1/N frequency divider 654.

An output from the reference clock oscillator 650 is divided by the 1/M frequency divider 651, and then is input to the phase comparator 652. An output from the phase comparator 652 is input to the VCO 653. An output from the VCO 653 is a clock output CLK_D. The output.from the VCO 650 is also divided by the 1/N frequency divider 654 and then is provided to the phase comparator 652.

As a result, the clock output CLK_D has a frequency N/M of an oscillation frequency of the reference clock oscillator 650. Setting a coefficient M to the 1/M frequency divider 651 and a coefficient N to the 1/N frequency divider 654 allows setting the clock output CLK_D to a desirable frequency according to a combination of the coefficients M and N. In other words, the rotational speed of each of the PC drums 501C, 501Y, 501M, and 501K may be adjusted.

Figure 15:
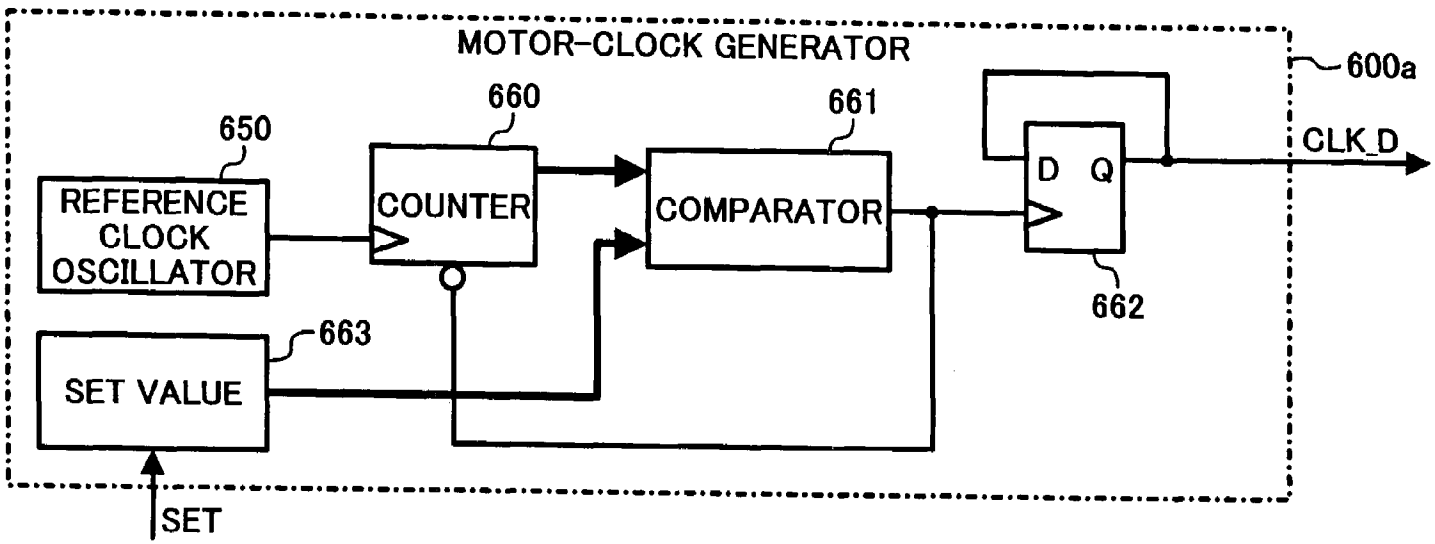
FIG. 15 is a diagram for explaining another example circuit of the motor-clock generator of FIG. 5.

Referring to FIG. 15, a configuration of another example circuit of the motor-clock generator 600*a* is described. The circuit includes the reference clock generator 650, a counter 660, a comparator 661, and a flip-flop 662. The output from the reference clock generator 650 is input to a count-input terminal of the counter 660.

A counted value is input to the comparator 661 to be compared with a set value 663. When the comparator 661 determines that the counted value and the set value 663 are equal, the comparator 661 outputs an "equal-value" pulse. The pulse is input to the flip-flop 662 to be divided by two for 50% duty cycle and output as the clock output CLK_D. Setting the set value 663 to a desirable value allows setting of the cycle of the clock output CLK_D. In other words, the rotational speed of the PC drum may be adjusted.

Referring back to the optical writing unit 500 in FIGS. 6A and 6B, the positions of the sync detectors 702C, 702Y, 702M, and 702K may be located on opposite sides in the main scanning direction due to the positional relationship between each LD unit 701 C, 701 Y, 701M, and 701K and the polygon mirror 700. For example, the sync detectors 702K and 702M and the sync detectors 702C and 702Y are located on opposite sides.

The positions of the sync detectors 702C, 702Y, 702M, and 702K are where writing for each color component starts and may be referred to as synchronization detection positions. Based on the synchronization detection position, for each color, a valid image range is determined within a laser scanning range according to a size of a recording medium.

Figure 16:
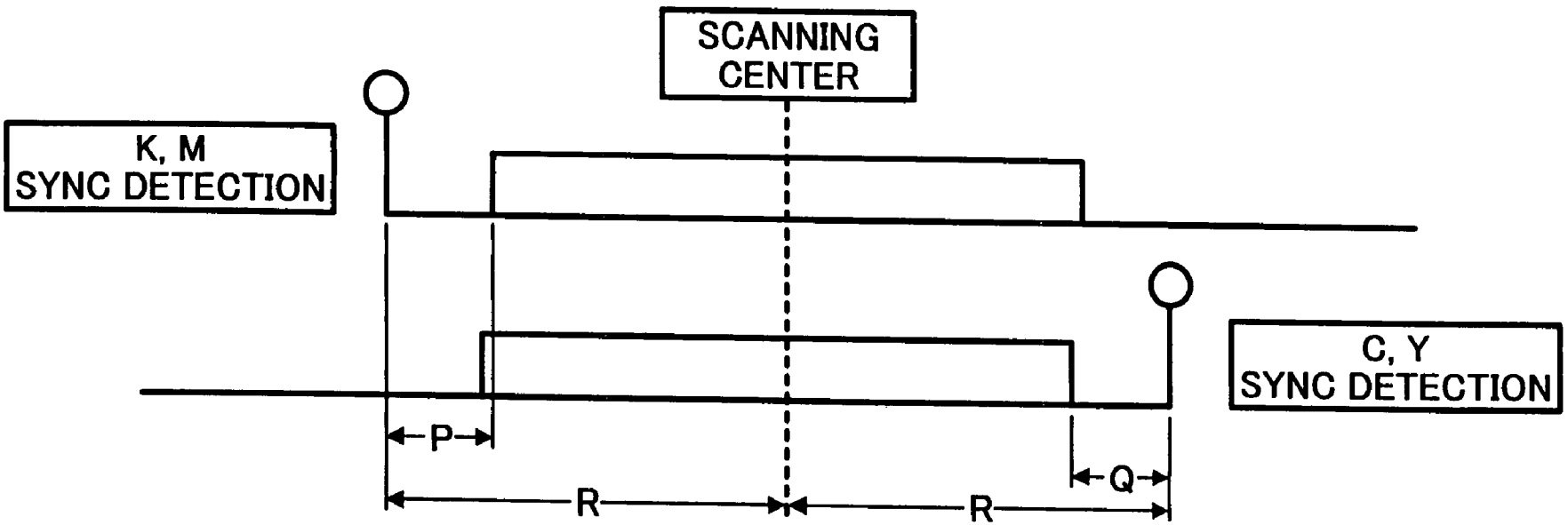
FIG. 16 is a schematic diagram for explaining how a main-scan misregistration may occur due to a calculation of a valid image range.

As a result, a calculation result of the valid image range may differ among each color component as illustrated in FIG. 16.

In FIG. 16, each of P and Q denotes a distance between an end of the valid image range and the synchronization detection position. R denotes a distance from a scanning center to the synchronization detection position on both sides.

Since K and M, or C and Y, are scanned in the same direction, a misregistration between K and M, or C and Y, may be as small as a placement error, if any, of the sync detectors 701K, 701M, 701C, and 701Y.

Assuming that the scanning range is symmetrical to the scanning center, P and Q should be equal. However, a size of the valid image range within the scanning range is rarely calculated as an integral multiple of a pixel size. In a background image forming apparatus that may correct misregistration in a unit of a pixel size, when the size of the valid image range cannot be divided by a pixel size without a remainder, the remainder has been rounded down. Since C and Y are scanned from a direction opposite from K and M, every time the calculation is performed after the size of the recording medium changes, color misregistration, of which amount depends on the size of the recording medium, may have occurred. The color misregistration may become more noticeable on a specific size of the recording medium than on other sizes.

In the example embodiment, since a misregistration smaller than the unit of the pixel (i.e. the width of the pixel) may be adjusted by controlling a phase of a pixel clock signal, the valid image range of each color component may be adjusted to a level smaller than the width of the pixel.

As a specific example, assume that the size of the recording medium is A4 (i.e. 297 mm in the main scanning direction), and that resolution is 600 dpi. Since R is 160 mm and 1 inch is 25.4 mm, calculation of P and Q will be as follows:

$$P=Q=(160-297/2)/25.4^{*}=271.654 \text{ pixels.}$$

If a fractional portion is rounded down, the result would be P=Q=271 pixels. Then the color components on the opposite sides may deviate for the dropped 0.654 pixels as illustrated in FIG. 16.

In the example embodiment, a width of a pixel may be increased or decreased in a unit of ⅛ (i.e. 0.125) of the pixel clock cycle. Among the 271 pixels constituting each of P and Q, the number of pixels to be corrected is calculated as:

$$0.654/0.125=5.232.$$

Since the number of pixel is an integer, 5 pixels are phase-controlled to have a lower frequency (i.e. widened). In this manner, the valid image range for K and M and the valid image range for C and Y are more accurately registered in the main scanning direction within the scanning range.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JP2005-003258 filed on Jan. 7, 2005 in the Japanese Patent Office, the entire contents of which are hereby incorporated by reference herein.

The invention claimed is:

1. An image forming apparatus comprising:

a plurality of photoconductive members arranged in parallel, each corresponding to one of a plurality of color components that form a target image data;

a memory device configured to prestore control information and registration pattern data;

an optical writing device configured to form a latent image of each one of the plurality of color components on a corresponding one of the photoconductive members by controlling a laser beam based on the control information;

a traveling member configured to travel in a direction perpendicular to a direction in which the plurality of photoconductive members are arranged;

a toner pattern forming device configured to form a toner pattern, which includes a plurality of marks of the plurality of color components, on the traveling member according to the registration pattern data;

a position detecting device configured to detect each of the plurality of marks in the toner pattern formed on the traveling member by the toner pattern forming device;

a control information correcting device configured to correct the control information according to a difference among positions of the plurality of marks detected by the position detecting device;

a main-scan registration correcting device configured to adjust, based on the corrected control information, a start-of-write timing in the main scanning direction in a unit of a pixel, clock cycle and to adjust a writing timing in the main scanning direction in a unit smaller than the pixel clock cycle by controlling a phase of the pixel clock cycle;

a sub-scan registration correcting device configured to independently control a rotational speed of each of the plurality of photoconductive members of a corresponding one of the plurality of color components; and an image range correcting device configured to allocate a fraction generated by a calculation of a valid image range, calculated for each of the plurality of color components as a number of pixels based on a size of a recording medium within a main scanning range of a laser beam, to some of the pixels out of the valid image range by controlling a phase of pixel clock cycles corresponding to the pixels so as to correct dimensions of each valid image range in the main-scanning direction.

2. An image forming apparatus comprising:

a plurality of photoconductive members arranged in parallel, each corresponding to one of a plurality of color components that form a target image data;

a memory device configured to prestore control information and registration pattern data;

an optical writing device configured to form a latent image of each one of the plurality of color components on a corresponding one of the photoconductive members by controlling a laser beam based on the control information;

a traveling member configured to travel in a direction perpendicular to a direction in which the plurality of photoconductive members are arranged;

means for forming a toner pattern, which includes a plurality of marks of the plurality of color components, on the traveling member according to the registration pattern data;

means for detecting each of the plurality of marks in the toner pattern formed on the traveling member by the means for forming;

means for correcting the control information according to a difference among positions of the plurality of marks detected by the means for detecting;

means for adjusting, based on the corrected control information, a start-of-write timing in the main scanning direction in a unit of a pixel clock cycle and adjusting a writing timing in the main scanning direction in a unit smaller than the pixel clock cycle by controlling a phase of the pixel clock cycle;

means for correcting a sub-scanning registration by independently controlling a rotational speed of each of the plurality of photoconductive members of a corresponding one of the plurality of color components; and means for allocating a fraction generated by a calculation of a valid image range, calculated for each of the plurality of color components as a number of pixels based on a size of a recording medium within a main scanning range of a laser beam, to some of the pixels out of the valid image range by controlling a phase of pixel clock cycles corresponding to the pixels so as to correct dimensions of each valid image range in the main-scanning direction.

3. An image forming apparatus comprising:

a plurality of photoconductive members arranged in parallel, each corresponding to one of a plurality of color components that form a target image data;

a memory device configured to prestore control information and registration pattern data;

an optical writing device configured to form a latent image of each one of the plurality of color components on a corresponding one of the photoconductive members by controlling a laser beam based on the control information;

a traveling member configured to travel in a direction perpendicular to a direction in which the plurality of photoconductive members are arranged;

a toner pattern forming device configured to form a toner pattern, which includes a plurality of marks of the plurality of color components, on the traveling member according to the registration pattern data;

a position detecting device configured to detect each of the plurality of marks in the toner pattern formed on the traveling member by the toner pattern forming device;

a control information correcting device configured to correct the control information according to a difference among positions of the plurality of marks detected by the position detecting device;

a main-scan registration correcting device configured to adjust, based on the corrected control information, a start-of-write timing in the main scanning direction in a unit of a pixel clock cycle and to adjust a writing timing in the main scanning direction in a unit smaller than the pixel clock cycle by controlling a phase of the pixel clock cycle; and a sub-scan registration correcting device configured to adjust, based on the corrected control information, a writing timing in the sub-scanning direction in a unit of a main scan line, and to independently control a rotational speed of each of the plurality of photoconductive members of a corresponding one of the plurality of color components so that a writing timing of each of the plurality of photoconductive members are adjusted at a level smaller than the main scan line.

4. An image forming apparatus of claim 3, wherein the control information prestored in the memory device includes information to control a writing timing in the main scanning direction and sub-scanning direction.

5. An image forming apparatus of claim 3, wherein the phase of the pixel clock cycle is controlled by controlling a frequency of the pixel clock cycle.

6. An image forming apparatus of claim 3, further comprising an image range correcting device configured to allocate a fraction generated by a calculation of a valid image range, calculated for each of the plurality of color components as a number of pixels based on a size of a recording medium within a main scanning range of a laser beam, to some of the pixels out of the valid image range by controlling a phase of pixel clock cycles corresponding to the pixels so as to correct dimensions of each valid image range in the main-scanning direction.

7. An image forming apparatus comprising:

a plurality of photoconductive members arranged in parallel, each corresponding to one of a plurality of color components that form a target image data;

a memory device configured to prestore control information and registration pattern data;

an optical writing device configured to form a latent image of each one of the plurality of color components on a corresponding one of the photoconductive members by controlling a laser beam based on the control information;

a traveling member configured to travel in a direction perpendicular to a direction in which the plurality of photoconductive members are arranged;

means for forming a toner pattern, which includes a plurality of marks of the plurality of color components, on the traveling member according to the registration pattern data;

means for detecting each of the plurality of marks in the toner pattern formed on the traveling member by the means for forming;

means for correcting the control information according to a difference among positions of the plurality of marks detected by the means for detecting;

means for adjusting, based on the corrected control information, a start-of-write timing in the main scanning direction in a unit of a pixel clock cycle and adjusting a writing timing in the main scanning direction in a unit smaller than the pixel clock cycle by controlling a phase of the pixel clock cycle; and means for adjusting, based on the corrected control information, a writing timing in the sub-scanning direction in a unit of a main scan line, and to independently control a rotational speed of each of the plurality of photoconductive members of a corresponding one of the plurality of color components so that a writing timing of each of the plurality of photoconductive members are adjusted at a level smaller than the main scan line.

8. An image forming apparatus of claim 7, wherein the control information prestored in the memory device includes information to control a writing timing in the main scanning direction and sub-scanning direction.

9. An image forming apparatus of claim 7, wherein the phase of the pixel clock cycle is controlled by controlling a frequency of the pixel clock cycle.

10. An image forming apparatus of claim 7, further comprising means for allocating a fraction generated by a calculation of a valid image range, calculated for each of the plurality of color components as a number of pixels based on a size of a recording medium within a main scanning range of a laser beam, to some of the pixels out of the valid image.

* * * * *